US011280505B2

(12) United States Patent
Liu et al.

(10) Patent No.: US 11,280,505 B2
(45) Date of Patent: Mar. 22, 2022

(54) HUMIDIFIER

(71) Applicant: ZHONGSHAN STYLE ELECTRIC APPLIANCES TECHNOLOGY CO., LTD, Zhongshan (CN)

(72) Inventors: Tao Liu, Zhongshan (CN); Baoping Wan, Zhongshan (CN); Liping Zhang, Zhongshan (CN); Limin Hu, Zhongshan (CN); Xiaopeng Qin, Zhongshan (CN)

(73) Assignee: ZHONGSHAN STYLE ELECTRIC APPLIANCES TECHNOLOGY CO., LTD, Zhongshan (CN)

( * ) Notice: Subject to any disclaimer, the term of this patent is extended or adjusted under 35 U.S.C. 154(b) by 90 days.

(21) Appl. No.: 16/575,378

(22) Filed: Sep. 18, 2019

(65) Prior Publication Data

US 2021/0018194 A1 Jan. 21, 2021

Related U.S. Application Data

(63) Continuation of application No. PCT/CN2019/100913, filed on Aug. 16, 2019.

(30) Foreign Application Priority Data

Jul. 15, 2019 (CN) ..... 201921108697.9

(51) Int. Cl.
*F24F 6/02* (2006.01)
*F24F 6/00* (2006.01)

(52) U.S. Cl.
CPC ..... *F24F 6/025* (2013.01); *F24F 2006/008* (2013.01)

(58) Field of Classification Search
CPC ..... F24F 6/06; F24F 6/025; F24F 2006/008
See application file for complete search history.

(56) References Cited

U.S. PATENT DOCUMENTS

2002/0180073 A1* 12/2002 Mulvaney ..... F24F 6/043 261/104
2015/0308732 A1* 10/2015 Lee ..... F24F 3/14 62/291
2017/0304861 A1* 10/2017 Seo ..... F24F 6/16

FOREIGN PATENT DOCUMENTS

| | | | |
|---|---|---|---|
| CN | 104197459 | A | 12/2014 |
| CN | 206771619 | U | 12/2017 |
| CN | 207797303 | U | 8/2018 |
| CN | 208566978 | U | 3/2019 |
| CN | 208704082 | U | 4/2019 |
| CN | 208936393 | U | 6/2019 |
| CN | 208967969 | U | 6/2019 |
| GB | 2471069 | A | 12/2010 |

* cited by examiner

*Primary Examiner* — Stephen Hobson

(57) ABSTRACT

A humidifier includes a shell, a fixing bracket, an atomizer, and a control circuit assembly, and the fixing bracket is disposed in a containing cavity of the shell and divides the containing cavity into a first isolating cavity and a second isolating cavity opposite to each other; the control circuit assembly is disposed in the first isolating cavity, and a solution is contained in the second isolating cavity; the atomizer is positioned in the solution of the second isolating cavity and electrically connected to the control circuit assembly. The control circuit assembly controls the atomizer to atomize the solution.

9 Claims, 5 Drawing Sheets

HUMIDIFIER

CROSS-REFERENCE TO RELATED APPLICATIONS

This application claims the benefit of Chinese patent application No. 201921108697.9 filed on Jul. 16, 2019, and PCT patent application PCT/CN20191100913 filed on Aug. 16, 2019. All the above are hereby incorporated by reference in their entirety.

BACKGROUND

Technical Field

The present disclosure relates to the technical field of humidifiers, and particularly relates to a new humidifier.

Background Art

With the development of society and the improvement of living standards, the quality of people's life has been continuously improved, and people's awareness of their health have also changed greatly. Autumn and winter seasons are the driest seasons of the year, especially in the north, where the air is very thy, which brings some hidden dangers to human skin and health. Hence, a humidifier becomes an indispensable household appliance, which can increase the humidity of the air and keeps the skin moisturized. Therefore, various humidifiers have appeared on the market. Currently, water tanks of conventional humidifiers circulating on the market are mostly placed on a top portion of the humidifiers, and the circuit components are in direct contact with water, which may cause electrocution and personal injury.

SUMMARY

The present disclosure provides a humidifier, and aims to solve the technical problems that the water tank of the conventional humidifier is disposed on the top portion, the circuit component is in direct contact with water, which may cause electrocution and personal injury.

In order to solve the above technical problems, the technical solution adopted by the present disclosure is as follows: the present application provides a humidifier, comprising: a shell, a fixing bracket, an atomizer, and a control circuit assembly, wherein the shell has a containing cavity; the fixing bracket is disposed in the containing cavity, and the fixing bracket divides the containing cavity into a first isolating cavity and a second isolating cavity; the control circuit assembly is disposed in the first isolating cavity, the second isolating cavity is used for containing a solution; the atomizer is positioned in the second isolating cavity and is in contact with the solution, and the atomizer is electrically connected to the control circuit assembly.

Preferably, the shell comprises an end cover and a main housing, the end cover is located at an upper portion of the main housing and forms the containing cavity with the main housing, the end cover is detachably connected to the main housing; the fixing bracket is secured to the end cover.

Further, the fixing bracket comprises an isolating frame body fixed to the end cover, the end cover and one side of the isolating frame body together form the first isolating cavity, other sides of the isolating frame body and the main housing form the second isolating cavity; and the isolating frame body has a first opening for communicating the first isolating cavity and the second isolating cavity, the end cover has a mist outlet in communication the first isolating cavity. The humidifier further comprising a mist guiding member used for communicating the first opening with the mist outlet, a first end of the mist guiding member is connected to the isolating frame body, and a second end of the mist guiding member is connected to the end cover.

Further, the mist guiding member comprises a mist guiding pipe, an outer mist outlet pipe, and an inner mist outlet pipe, wherein a first end of the mist guiding pipe is connected to the first opening of the isolating frame body and a second end of the mist guiding pipe extends toward the mist outlet; the inner mist outlet pipe is located in a pipe cavity of the outer mist outlet pipe, and a first end of the inner mist outlet pipe and a first end of the outer mist outlet pipe are connected to the mist outlet of the end cover, and a second end of the inner mist outlet pipe and a second end of the outer mist outlet pipe extend towards the direction of the isolating frame body; an outer pipe wall of the inner mist outlet pipe, an inner pipe wall of the outer mist outlet pipe and an inner wall between inner mist outlet pipe and the outer mist outlet pipe in the end cover jointly form an annular slot; the second end of the mist guiding pipe is connected with the second end of the outer mist outlet pipe, or the second end of the mist guiding pipe is inserted into a cavity of the outer mist outlet pipe, or the second end of the mist guiding pipe is inserted into the annular slot.

As an alternative, the mist guiding member comprises a mist guiding pipe having a first end connected to the first opening of the isolating frame body and a second end extending toward the mist outlet, and an outer mist outlet pipe having a first end connected to the mist outlet of the end cover and a second end extending toward the isolating frame body; the second end of the mist guiding pipe is connected with the second end of the outer mist outlet pipe, or the second end of the mist guiding pipe is inserted into a cavity of the outer mist outlet pipe.

Preferably, the inner mist outlet pipe is in a shape of a trumpet, and an opening direction of the trumpet faces away from the isolating frame body.

Preferably, the humidifier further comprising a fan located in the first isolating cavity, wherein the fan is electrically connected to the control circuit assembly, the fan has an air inlet and an air outlet, the isolating frame body has a second opening, and the second opening corresponds to the air outlet; the end cover has at least one air intake hole.

Preferably, the fixing bracket further comprises a wind guiding wall disposed within the second isolating cavity, and the wind guiding wall is connected to the isolating frame body and communicates with the second opening.

Preferably, the humidifier further comprising a float floating on a surface of the solution, the atomizer is fixed to the float and floats on the surface of the solution or is suspended in the solution together with the float.

Preferably, the humidifier comprising a viewing window for viewing a liquid level of the solution in the second isolating cavity, wherein the shell has a viewing port, the viewing port is in communicated with the second isolating cavity, and the viewing window is positioned at the viewing port.

In a further embodiment, the present application provides a humidifier, comprising: a shell, wherein the shell has a containing cavity comprising a fixing bracket, wherein the fixing bracket is positioned in the containing cavity to divide the containing cavity into a first isolating cavity and a second isolating cavity, and wherein the second isolating cavity is used for containing a solution; a control circuit assembly disposed in the first isolating cavity; and an atomizer positioned in the second isolating cavity and in contact with the solution, wherein the atomizer is electrically connected to the control circuit assembly.

Preferably, the shell comprises an end cover and a main housing, the end cover is located at an upper portion of the main housing and forms the containing cavity with the main housing, the end cover is detachably connected to the main housing; the fixing bracket is secured to the end cover.

Further, the fixing bracket comprises an isolating frame body fixed to the end cover, the end cover and one side of the isolating frame body together form the first isolating cavity, other sides of the isolating frame body and the main housing form the second isolating cavity; and the isolating frame body has a first opening for communicating the first isolating cavity and the second isolating cavity, the end cover has a mist outlet in communication with the first isolating cavity; the humidifier further comprising a mist guiding member used for communicating the first opening with the mist outlet, one end of the mist guiding member is connected to the isolating frame body, and a second end of the mist guiding member is connected to the end cover.

Further, the mist guiding member comprises a mist guiding pipe having a first end connected to the first opening of the isolating frame body and a second end extending toward the mist outlet, and an outer mist outlet pipe having a first end connected to the mist outlet of the end cover and a second end extending toward the isolating frame body; the second end of the mist guiding pipe is connected with the second end of the outer mist outlet pipe.

As an alternative, the mist guiding member comprises a mist guiding pipe having a first end connected to the first opening of the isolating frame body and a second end extending toward the mist outlet, and an outer mist outlet pipe having a first end connected to the mist outlet of the end cover and a second end extending toward the isolating frame body; the second end of the mist guiding pipe is inserted into a cavity of the outer mist outlet pipe.

A beneficial effect of the present disclosure: the shell has a containing cavity, the fixing bracket is disposed in the containing cavity, and the fixing bracket divides the containing cavity into a first isolating cavity and a second isolating cavity which are opposite, the control circuit assembly is disposed in the first isolating cavity, a solution is contained in the second isolating cavity, a atomizer is positioned in the solution in the second isolating cavity and electrically connected to the control circuit assembly, and the control circuit assembly controls the atomizer so that the atomizer atomizes the solution in the second isolating cavity. Thus by the arrangement of the fixing; bracket, the containing cavity is divided into a first isolating cavity for installing the control circuit assembly and a second isolating cavity for storing the solution, thereby effectively separating the liquid and electricity, and preventing direct contact between the control circuit assembly and the solution, improving the overall safety index and extending, service life of the control circuit assembly.

DETAILED DESCRIPTION OF THE EMBODIMENTS

To make the objects, technical solutions and advantages of the present disclosure more comprehensible, the present disclosure will be further described in detail below regarding the accompanying drawings and embodiments. It should be understood that the specific embodiments described herein are merely illustrative of the disclosure and are not intended to limit the disclosure.

It should be noted that when an element is referred to as being "fixed" or "disposed" on another element, it can be directly fixed or disposed on the other element or it can be indirectly fixed or disposed on the other element through a third component. When an element is referred to as being "connected" to another element, it can be directly connected to the other element or it can be indirectly connected to the other element through a third component.

It is to be understood that the terms "length, width, upper, lower, front, rear, left, right, vertical, horizontal, top, bottom, inner, outer", and the like, refer to orientations or positional relationships based on the orientations or positional relationships shown in the figures. It is intended merely to facilitate a description of the present disclosure and to simplify the description, rather than to indicate or imply that a device or element referred to must have a particular orientation, be constructed and operated in a particular orientation, and thus should not be construed as limiting the present disclosure.

Furthermore, the terms "first" and "second" are used for descriptive purposes only and are not to be construed as indicating or implying relative importance or implicitly indicating the number of technical features indicated. Thus, features defining "first" and "second" may explicitly or implicitly include one or more such features. In the description of the present disclosure, "a plurality" means two or more unless specifically defined otherwise.

Figure 1:
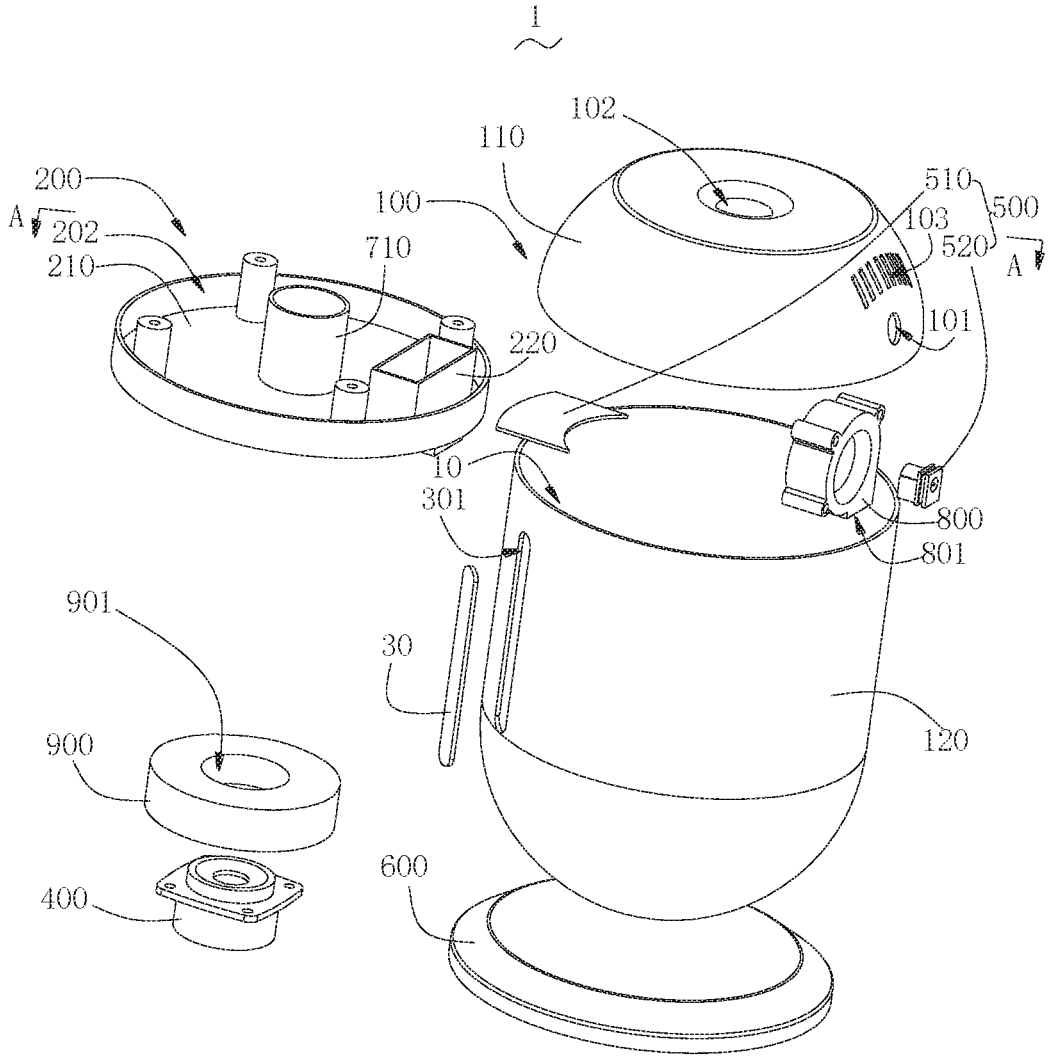
FIG. 1 is an exploded perspective view of a humidifier according to an embodiment of the present disclosure.
Figure 2:
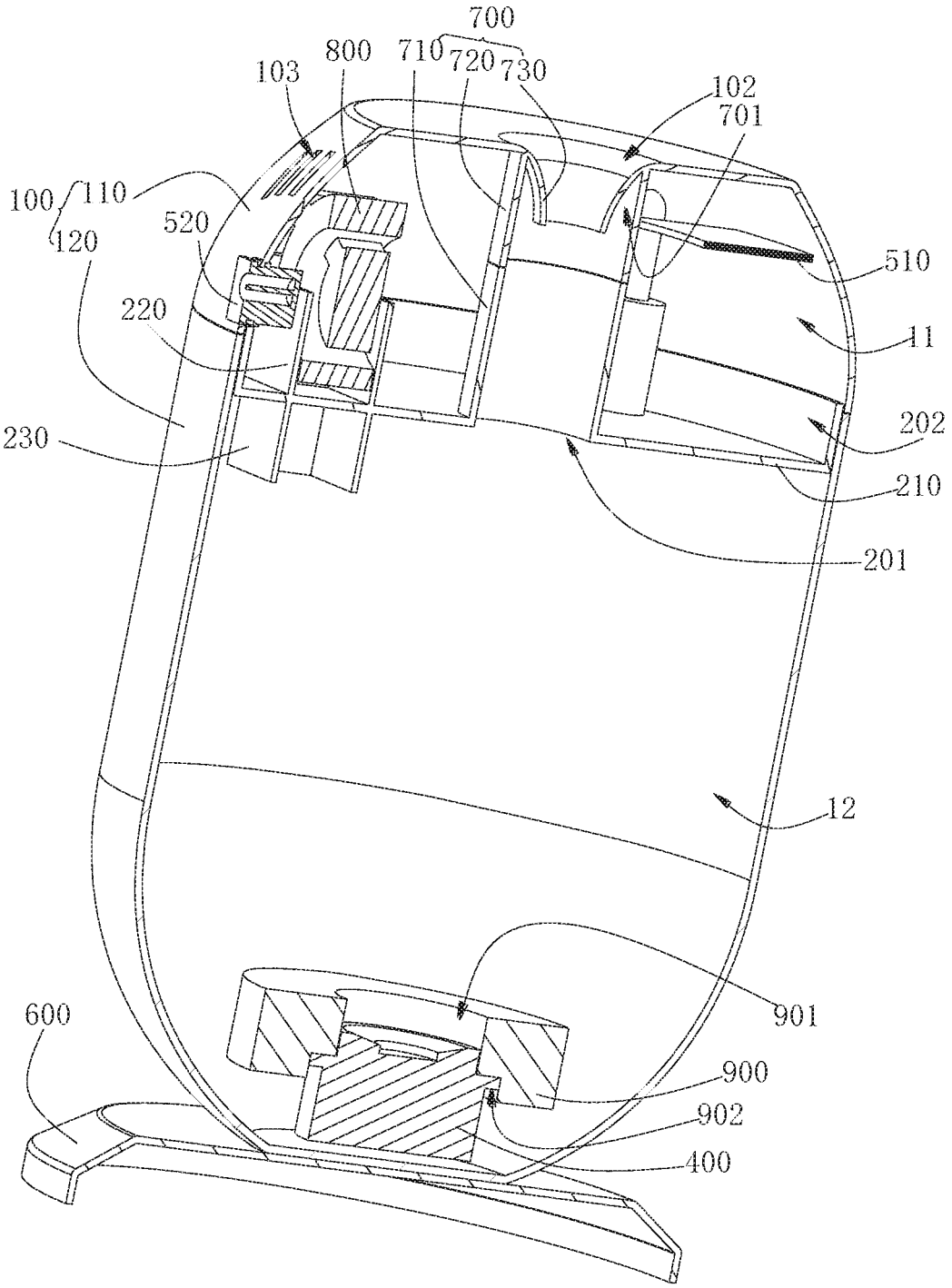
FIG. 2 is a perspective cross-sectional view of FIG. 1 taken along line A-A.
Figure 3:
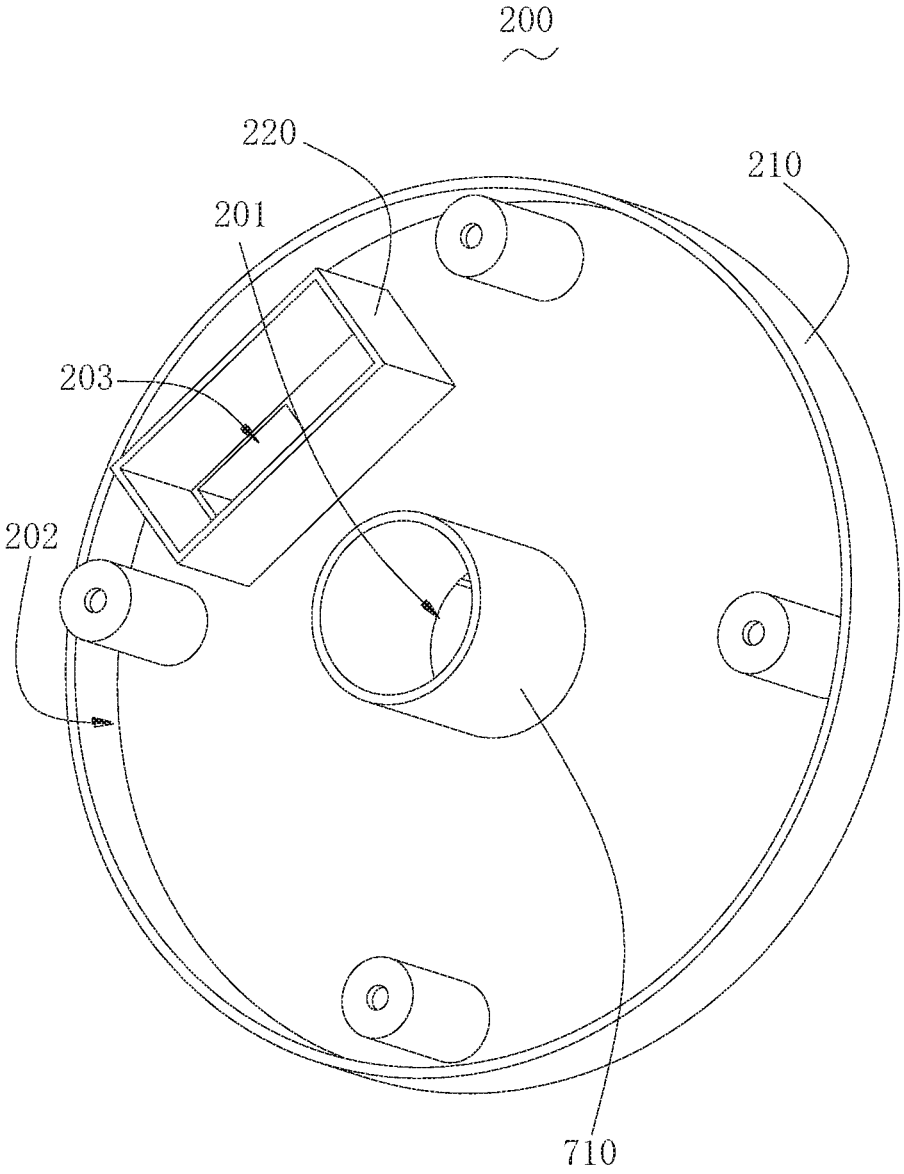
FIG. 3 is a perspective view of a fixing bracket according to an embodiment of the present disclosure.
Figure 4:
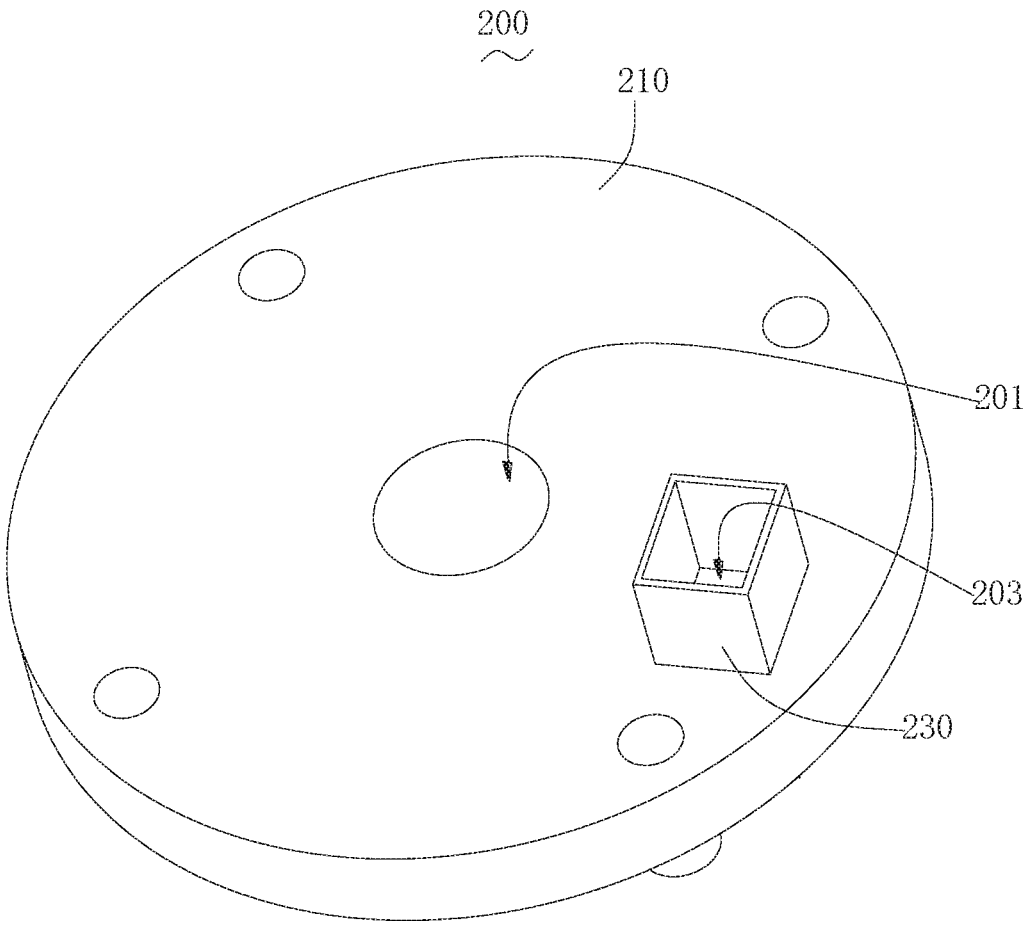
FIG. 4 is another angular perspective view of the fixing; bracket according to an embodiment of the present disclosure.

Referring to FIG. 1 and FIG. 2, an embodiment of the present disclosure provides a humidifier 1 that comprises a shell 100, a fixing bracket 200, an atomizer 400, and a control circuit assembly 500, wherein the shell 100 has a containing cavity 10; the fixing bracket 200 is disposed in the containing cavity 10, and the fixing bracket 200 divides the containing cavity 10 into a first isolating cavity 11 and a second isolating cavity 12; the control circuit assembly 500 is disposed in the first isolating cavity 11, the second isolating cavity 12 is used for containing a solution; the atomizer 400 is positioned in the second isolating cavity 12 and is in contact with the solution, and the atomizer 400 is electrically connected to the control circuit assembly 500.

In this embodiment, the shell 100 has the containing cavity 10, the fixing bracket 200 is disposed in the containing cavity 10, and the fixing bracket 200 divides the containing cavity 10 into a first isolating cavity 11 and a second isolating cavity 12 that are disposed opposite to each other. The control circuit assembly 500 is disposed in the first isolating cavity 11, the solution is contained in the second isolating cavity 12, and the atomizer 400 is positioned in the solution in the second isolating cavity 12 and electrically connected to the control circuit assembly 500. The control circuit assembly 500 controls the atomizer 400 so that the atomizer 400 atomizes the solution in the second isolating cavity 12. Thus, by the arrangement of the fixing bracket 200, the containing cavity 10 is divided into the first isolating cavity 11 for disposal of the control circuit assembly 500, and the second isolating cavity 12 for storing the solution. Thus, the particular arrangement of the separation of individual elements in separate isolating cavities 11, 12 effectively separates solutions from electricity, and avoids direct contact between the control circuit assembly 500 and the solution, thus improving the overall safety index and extending service life of the control circuit assembly 500.

In the present disclosure, the first isolating cavity 11 may be positioned above the second isolating cavity 12 or under the second isolating cavity 12, and the first isolating cavity 11 and the second isolating cavity 12 may also be located left and right to each other. However, it is not limited thereto, and the present disclosure only needs to satisfy that the first isolating cavity 11, containing the control circuit assembly 500, to be disposed to be isolated from the second isolating cavity 12 containing the solution. In this embodiment, the first isolating cavity 11 is positioned relatively above the second isolating cavity 12.

Referring, to FIG. 1 and FIG. 2, the shell 100 comprises an end cover 110 and a main housing 120. The end cover 110 is located at an upper portion of the main housing 120 and for us the containing cavity 10 with the main housing 120. The end cover 110 is detachably connected to the main housing 120, and the fixing bracket 200 is secured to the end cover 110. It can be understood that the control circuit assembly 500 is disposed between the end cover 110 and the fixing bracket 200, and the solution is contained in the main housing 120.

In this embodiment, the end cover 110 is detachably connected to the main housing 120 and forms the containing, cavity 10 together with the main housing 120. The fixing bracket 200 is located in the containing cavity 10 and fixed to the end cover 110. When adding the solution, it is only necessary to open the end cover 110. At this time, the end cover 110 is separated from the main housing 120 together with the fixing bracket 200, and the solution can be directly poured into the main housing 120, which is convenient to use. Moreover, the internal structure of the main housing 120 is simple without any complicated structure, which makes the main housing 120 convenient for direct cleaning Moreover, the end cover 110 is detachably connected to the main housing 120, so that the efficiency of fastening and opening of the end cover 110 is improved, convenient for the user to use, thereby improving the user experience with the humidifier 1.

The end cover 110 is detachably connected to the main housing 120. The connection structure may be a snap connection or a magnetic connection, but the detachable connection structure between the end cover 110 and the main housing 120 is not limited thereto.

In one embodiment, the atomizer 400 is an ultrasonic water heater or heater.

In one embodiment, the control circuit assembly 500 comprises a control circuit board 510 electrically connected to the atomizer 400 and a power connector 520 electrically connected to the control circuit board 510. The end cover 110 has a power interface 101 in communication with the first isolating cavity 11. The power connector 520 is fixed to the power interface 101. Of course, the control circuit assembly 500 can also include a battery electrically connected to the control circuit board 510, so that it can be used without being need to be plugged into a power source, and can be moved to any place without a power source to improve convenience.

In one embodiment, the humidifier 1 further comprises a support pad 600, The main housing 120 is located above the support pad 600. Specifically, the support pad 600 is an inverted disc shape.

Referring to FIG. 1 and FIG. 2, the fixing bracket 200 comprises an isolating frame body 210 fixedly connected to the end cover 110. The end cover 110 and one side of the isolating frame body 210 together form the first isolating, cavity 11. The isolating frame body 210 and other sides of the main housing 120 together form a second isolating cavity 12. The isolating frame body 210 has a first opening 201 for communicating the first isolating cavity 11 with the second isolating cavity 12, and the end cover 110 has a mist outlet 102 in communication with the first isolating cavity 11.

The humidifier 1 further comprises a mist guiding member 700 for communicating the first opening 201 with the mist outlet 102, wherein a first end of the mist guiding member 700 is connected to the isolating frame body 210, and a second end of the mist guiding member 700 is connected to the end cover 110.

In one embodiment, the mist guiding member 700 is connected to the first opening 201 of the isolating frame body 210 and the mist outlet 102 of the end cover 110, so that the mist atomized by the atomizer 400 can be effectively guided to outside of the humidifier 1 through the first opening 201, the mist guiding member 700, and the mist outlet 102, It is important that mist atomized by the atomizer 400 does not enter the first isolating cavity 11 and does not contact the control circuit assembly 500, so that the overall safety can be improved more effectively.

In one embodiment, the isolating frame body 210 is in a shape of a disc with a receiving groove 202, and the first opening 201 has a groove bottom for the receiving groove 202.

Referring to FIG. 1 and FIG. 2, the mist guiding member 700 comprises a mist guiding pipe 710, an outer mist outlet pipe 720, and an inner mist outlet pipe 730, wherein a first end of the mist guiding pipe 710 is connected to the first opening 201 of the isolating frame body 210 and a second end of the mist guiding pipe 710 extends toward the mist outlet 102. The inner mist outlet pipe 730 is located in the pipe cavity of the outer mist outlet pipe 720. A first end of the inner mist outlet pipe 730 and a first end of the outer mist outlet pipe 720 are both connected to the mist outlet 102 of the end cover 110. A second end of the inner mist outlet pipe 730 and a second end of the outer mist outlet pipe 720 extend toward towards the direction of the isolating frame body 210. An outer pipe wall of the inner mist outlet pipe 730, an inner pipe wall of the outer mist outlet pipe 720 and an inner wall of the end cover 110 between the outer mist outlet pipe 730 and the inner wall between inner mist outlet pipe 730 in the end cover 110 jointly form an annular slot 701. The second end of the mist guiding pipe 710 is connected with the second end of the outer mist outlet pipe 720, or the second end of the mist guiding pipe 710 is inserted into a cavity of the outer mist outlet pipe 720, or the second end of the mist guiding pipe 710 is inserted into the annular slot 701. A cavity of the mist guiding pipe 710 is in communication with a cavity of the inner mist outlet pipe 730.

Preferably, the inner mist outlet pipe 730 is in a shape of a trumpet, and an opening direction of the trumpet faces away from the isolating frame body 210.

Referring to FIG. 1 and FIG. 2, optionally, the mist guiding member 700 comprises a mist guiding pipe 710 having a first end connected to the first opening 201 of the isolating frame body 210 and a second end extending toward the mist outlet 102, and an outer mist outlet pipe 102 having a first end connected to the mist outlet 102 of the end cover 110 and a second end extending toward the isolating frame body 210. The second end of the mist guiding pipe 710 is connected with the second end of the outer mist outlet pipe 720, or the second end of the mist guiding pipe 710 is inserted into a cavity of the outer mist outlet pipe 720. A cavity of the mist guiding pipe 710 is in communication with a cavity of the outer mist outlet pipe 720.

Referring to FIGS. 1 to 4, the humidifier 1 further comprises a fan 800 located in the first isolating cavity 11, wherein the fan 800 is electrically connected to the control circuit assembly 500. The fan 800 has an air inlet (not marked in the figures) and an air outlet 801, the isolating frame, body 210 has a second opening 203, and the second opening 203 corresponds to the air outlet 801. The end cover 110 has at least one air intake hole 103. Thus, by arrangement of the fan 800, it is possible to effectively form a vortex state of the mist in the main housing 120, and it is convenient for the mist to quickly pass through the first opening 201.

Preferably, the second opening 203 is located at the edge of the isolating frame body 210, so that the mist in the main housing 120 can be thoroughly agitated to accelerate the mist to pass through the first opening 201.

In one embodiment, the fixing bracket 200 further comprises a mounting wall 220 located in the first isolating cavity 11 and connected to the isolating frame body 210. The mounting wall 220 surrounds the second opening 203, and the fan 800 is disposed in the mounting wall 220. In this way, there is an increase in the amount of air that passes through the second opening 203.

Preferably, the fixing bracket 200 further comprises a wind guiding wall 230 disposed within the second isolating cavity 12, and the wind guiding wall 230 is connected to the isolating frame body 210 and communicates with the second opening 203.

In this embodiment, the wind guiding wall 230 is connected to the lower surface of the isolating frame body 210 and surrounds the second opening 203 for air export. In this way, the wind can be directed to the surface of the liquid, and the mist on the liquid surface is agitated by the wind and passed through the first opening 201.

Figure 5:
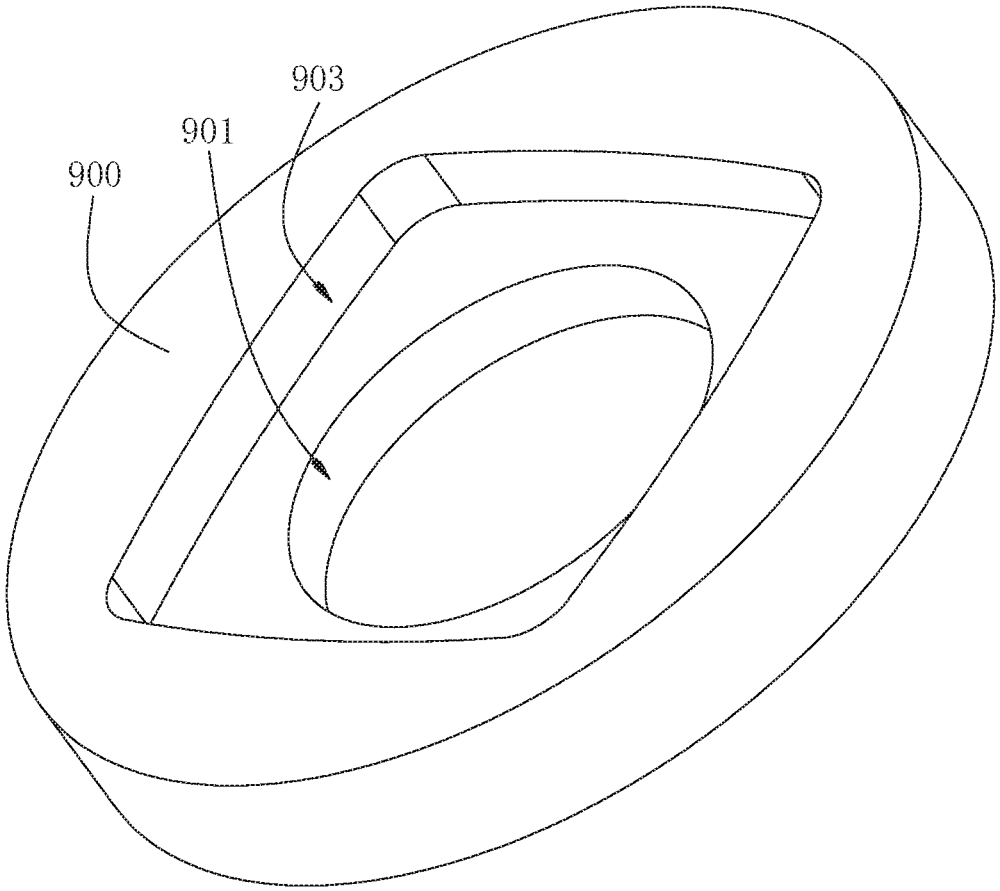
FIG. 5 is a perspective view of a float according to an embodiment of the present disclosure.

Referring to FIG. 1, FRI. 2, and FIG. 5, preferably, the humidifier 1 further comprises a float 900 that is floatable on a surface of the solution, and the atomizer 400 is fixed to the float 900 and floats together on the surface or is suspended in the solution with the float 900. Specifically, the atomizer 400 floats on the surface of the solution together with the float 900, or is suspended in the solution at a distance from the surface of the solution.

In one embodiment, the atomizer 400 is fixed to the float 900. The atomizer 400 is submerged at a certain position in the liquid by the self-weight of the float 900. When the liquid level changes, the float 900 changes the floating position according to the change of the liquid level, and the atomizer 400 is always kept at a certain distance from the liquid surface.

In one embodiment, the humidifier 1 further comprises a positioning member having a first end connected to the isolating frame body 210 and a second end extending toward the second isolating cavity 12, or having a first end connected to a wall of the second isolating cavity 12 and a second end extending toward the isolating frame body 210. The positioning member has a sliding cavity, and the sliding cavity extends along the depth direction of the solution. The float 900 is disposed in the sliding cavity and is in sliding fit with the positioning member. When the level of liquid rises or falls, the float 900 drives the atomizer 400 to float along the extension direction of the sliding cavity, to realize positioning and floating of the float 900 and the atomizer 400. Specifically, the positioning member is a sleeve having a first end connected to the isolating frame body 210 and a second end extending toward the second isolating cavity 12, or having a first end connected to the wall of the second isolating cavity 12 and the a second end extending towards the isolating frame body 210. The wall of the sleeve has at least one liquid passage opening to enable the level of the liquid in the sleeve to be same as the level of the liquid in the second isolating cavity 12. The float 900 and the atomizer 400 are disposed in the sliding cavity of the sleeve and float along the extending direction of the sliding cavity. Of course, the positioning member is not limited to the above described structure.

Specifically, the float 900 has a liquid-passing chamber 901 penetrating vertically. The atomizer 400 is fixed to the lower surface of the float 900, and one end of the atomizer 400 is inserted into the liquid-passing chamber 901.

The floating body 900 has a mounting groove 902 on the lower surface. The mounting groove 902 is opposite to and communicates with the liquid-passing chamber 901, and the atomizer 400 is fixed to the mounting groove 902.

Referring to FIG. 1, preferably, the humidifier 1 further comprises a viewing window 30 for viewing a liquid level of the solution in the second isolating cavity 12. The shell 100 has a viewing port 301, and the viewing window 30 is installed at the viewing port 301. It is understood that the viewing window 30 is transparent.

Preferably, the viewing window 30 has tick marks, so that not only the liquid level in the second isolating cavity 12, but also the accurate data of the liquid level can be obtained in real-time.

The above is merely a preferred embodiment of the present disclosure, and is not intended to limit the present disclosure. Any modifications, equivalent substitutions, and improvements made within the spirit and principles of the present disclosure are included within the scope of the claims of the present disclosure.

What is claimed is:

1. A humidifier, comprising: a shell, a fixing bracket, an atomizer, and a control circuit assembly, wherein the shell has a containing cavity; the fixing bracket is disposed in the containing cavity, and the fixing bracket divides the containing cavity into a first isolating cavity and a second isolating cavity; the control circuit assembly is disposed in the first isolating cavity; the second isolating cavity is used for containing a solution; the atomizer is positioned in the second isolating cavity and is in contact with the solution, and the atomizer is electrically connected to the control circuit assembly; wherein the shell comprises an end cover and a main housing, the fixing bracket comprises an isolating frame body fixed to the end cover, the end cover and one side of the isolating frame body together form the first isolating cavity, other sides of the isolating frame body and the main housing form the second isolating cavity; and the isolating frame body has a first opening for communicating the first isolating cavity and the second isolating cavity, the end cover has a mist outlet in communication with the first isolating cavity;

the humidifier further comprising a mist guiding member used for communicating the first opening with the mist outlet, a first end of the mist guiding member is connected to the isolating frame body, and a second end of the mist guiding member is connected to the end cover.

2. The humidifier according to claim 1, wherein the end cover is located at an upper portion of the main housing and forms the containing cavity with the main housing, the end cover is detachably connected to the main housing; the fixing bracket is secured to the end cover.

3. The humidifier according to claim 2, further comprising a float floating on a surface of the solution, the atomizer is fixed to the float and floats on the surface of the solution or is suspended in the solution together with the float.

4. The humidifier according to claim 1, wherein the mist guiding member comprises a mist guiding pipe having a first end connected to the first opening of the isolating frame body and a second end extending toward the mist outlet, and an outer mist outlet pipe having a first end connected to the mist outlet of the end cover and a second end extending toward the isolating frame body; the second end of the mist guiding pipe is connected with the second end of the outer mist outlet pipe, or the second end of the mist guiding pipe is inserted into a cavity of the outer mist outlet pipe.

5. The humidifier according to claim 1, wherein the mist guiding member comprises a mist guiding pipe, an outer mist outlet pipe, and an inner mist outlet pipe, wherein a first end of the mist guiding pipe is connected to the first opening of the isolating frame body and a second end of the mist guiding pipe extends toward the mist outlet; the inner mist outlet pipe is located in a pipe cavity of the outer mist outlet pipe, and a first end of the inner mist outlet pipe and a first end of the outer mist outlet pipe are connected to the mist outlet of the end cover, and a second end of the inner mist outlet pipe and a second end of the outer mist outlet pipe extend towards the direction of the isolating frame body; an outer pipe wall of the inner mist outlet pipe, an inner pipe wall of the outer mist outlet pipe and an inner wall between inner mist outlet pipe and the outer mist outlet pipe in the end cover jointly form an annular slot; the second end of the mist guiding pipe is connected with the second end of the outer mist outlet pipe, or the second end of the mist guiding pipe is inserted into a cavity of the outer mist outlet pipe, or the second end of the mist guiding pipe is inserted into the annular slot.

6. The humidifier according to claim 5, wherein the inner mist outlet pipe is in a shape of a trumpet, and an opening direction of the trumpet faces away from the isolating frame body.

7. The humidifier according to claim 1, further comprising a fan located in the first isolating cavity, wherein the fan is electrically connected to the control circuit assembly, the fan has an air inlet and an air outlet, the isolating frame body has a second opening, and the second opening corresponds to the air outlet; the end cover has at least one air intake hole.

8. The humidifier according to claim 7, wherein the fixing bracket further comprises a wind guiding wall disposed within the second isolating cavity, and the wind guiding wall is connected to the isolating frame body and communicates with the second opening.

9. The humidifier according to claim 1, further comprising a viewing window for viewing a liquid level of the solution in the second isolating cavity, wherein the shell has a viewing port, the viewing port is in communicated with the second isolating cavity, and the viewing window is positioned at the viewing port.

* * * * *